United States Patent [19]

Williams

[11] 4,206,525

[45] Jun. 10, 1980

[54] BEDSIDE FOOT-REST

[76] Inventor: Willie L. Williams, 722 W. 2nd St., Washington, N.C. 27889

[21] Appl. No.: 971,894

[22] Filed: Dec. 21, 1978

[51] Int. Cl.[2] ..... A47C 21/00

[52] U.S. Cl. ..... 5/507; 5/430

[58] Field of Search ..... 5/430, 507; 297/383, 297/438

[56] References Cited

U.S. PATENT DOCUMENTS

| | | | |
|---|---|---|---|
| 2,642,250 | 6/1953 | Kasnowich | 5/507 |
| 2,941,215 | 6/1960 | Johnson | 5/507 |
| 3,585,659 | 6/1971 | Burst et al. | 5/430 |
| 3,930,273 | 1/1976 | Stern | 5/430 |

*Primary Examiner*—Casmir A. Nunberg

[57] ABSTRACT

In a preferred embodiment, a bed-side foot-rest structure includes two elongated members separately mounted by upright bolts onto a side member of a bed frame, mounted for pivotal movement, distal ends of each of the two elongated members having mounted therebetween pivotally a foot-rest additional horizontal structure, the elongated members being horizontally extending and laterally horizontally pivotally mounted by the upright bolts such that when mounted, the foot-rest additional horizontal structure is collapsable to and extendable from beneath the side member of the bed frame, and when extended serves as a foot-rest for a person seated on a side of the bed.

3 Claims, 5 Drawing Figures

FIG. 3
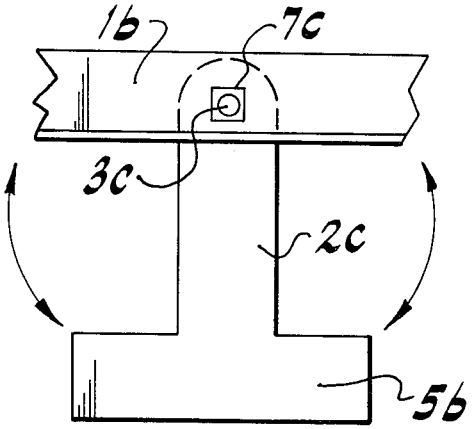
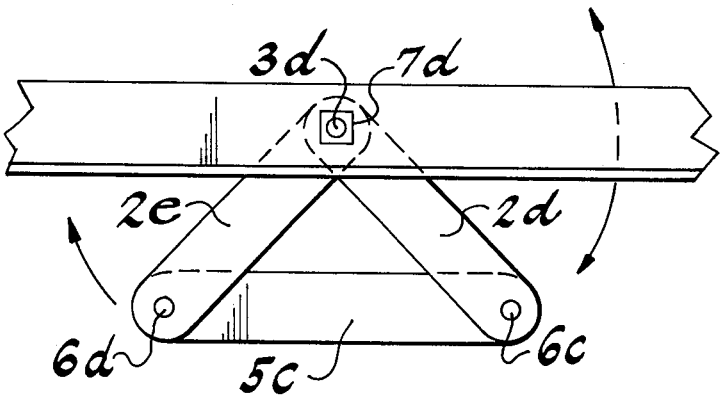
FIG. 4
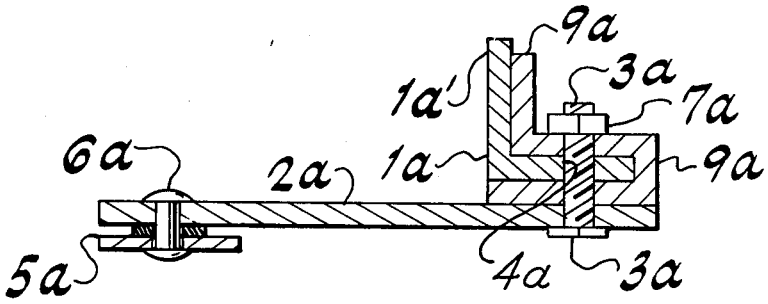
FIG. 5

BEDSIDE FOOT-REST

This invention relates to a retractable bed-side mounted foot-rest of improved design and novelty as hereinafter described.

BACKGROUND TO THE INVENTION

Heretofore there have existed prior patents directed to a foot-rest for use beside the bed, but the complexity thereof has made such totally impractical as well as unsightly, discouraging commercial development of such an item having an obvious basic need by most persons of our society. The bulky and cumbersome structure, and high cost of manufacture of prior devices have rendered them not commercially acceptable. Ease of operation has also been lacking.

THE INVENTION

Accordingly, objects of the present invention include the overcoming or avoiding of difficulties and disadvantages of the prior foot-rests for bed-side use, together with additional novel advantages.

Another object is to obtain a bed-frame mounted retractable foot-rest structure.

Another object is to obtain a bed-frame mountable foot-rest structure having a simple structure and method of manufacture and mounting thereof.

Another object is to obtain a sturdy bed-frame mountable foot-rest adapted for easy mounting and operation in movement to and from foot-rest and storage out-of-sight positions and states.

Another object is to obtain a foot-rest structure mountable onto a side of a bed-frame, of small and aesthetically acceptable appearance.

Other objects become apparent from the preceding and following disclosure.

One or more objects of the invention are obtained by the invention as typically illustrated by the drawings which are intended to improve understanding of the invention but are not intended to unduly limit the invention which includes variations and modifications and substitution of equivalents within the skill of an ordinary artisan.

Broadly the invention may be described as a combination of an elongated member and a pivot mechanism adapted for mounting the elongated member for horizontal pivotal movement onto and at a horizontal bed-frame support in order to provide support for a foot of person sitting on a side of a bed, in the nature of a retractable foot-rest structure.

Preferably included as a part of the foot-rest is an additional horizontally-extending structure continuous with and typically at about right angle to the elongated member.

Preferably there are two of the elongated member, with the additional horizontally-extending structure extending between and pivotally-mounted on each of the elongated members at the distal ends thereof. Also, more preferably, the proximate bed-frame-mounted ends of the elongated members are separately mounted on separate pivot-mounting mechanisms, whereby the two horizontally-extending members extend parallel to each other and are collapsible.

The attaching and pivoting mechanism for the mounting of the horizontal elongated members onto the bed-frame, preferably are each a nut and bolt, mounting the bolt through an aperture in a horizontal member, with the bolt extending uprightly, secured by the bolt.

The invention may be better understood by making reference to the following drawings.

THE FIGURES

FIG. 3 illustrate in in-part view, an alternate embodiment in elevation plan view.

FIG. 4 illustrates in in-part view, another alternate embodiment in elevation plan view.

FIG. 5 illustrates a side cross-sectional view as taken along lines 5—5 of FIG. 1 embodiment.

DETAILED DESCRIPTION

Figure 1:
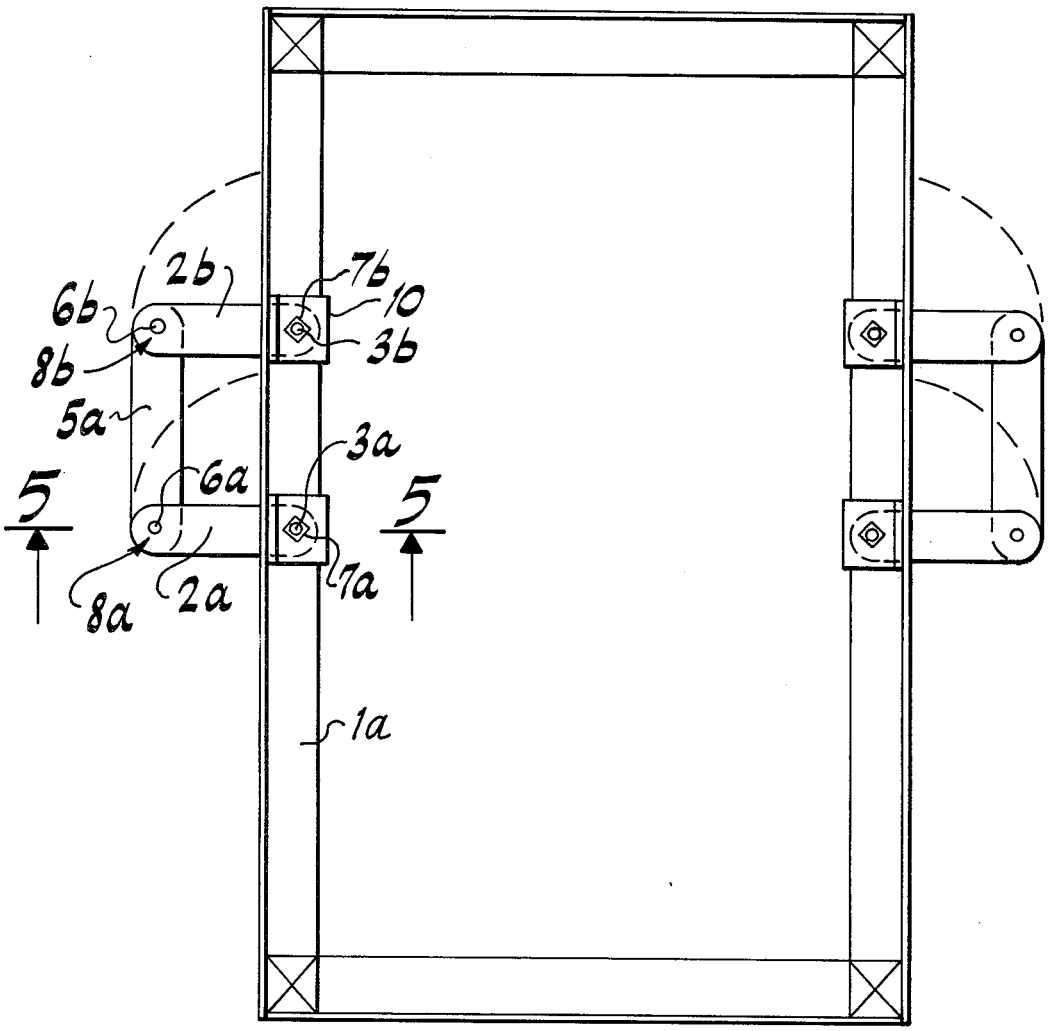
FIG. 1 is an elevation plan view of a bed-frame having a a bed-frame side member with a preferred embodiment foot-rest combination pitally-mounted thereon for horizontal pivotal movement to and fro between extended and retracted positions and states.

In greater detail, FIG. 1 shows the bed-frame side member 1*a*, having mounted thereon elongated members 2*a* and 2*b*, mounted by the bolts 3*a* and 3*b* through support 10 and secured by nuts 7*a* and 7*b*, thereby making possible horizontal pivital movement of the elongated members 2*a* and 2*b* which have rivits 6*a* and 6*b* pivotally mounting the additional horizontally-extending structure 5*a* at the opposite ends thereof, such that it extends parallel to the bed-side frame side member 1*a*. The bolts 3*a* and 3*b* extend through bolt-receiving apertures 4*a* and 4*b* (not visible) in side member 1*a*. The rivits extend through aligned apertures at 8*a* and 8*b*, apertures in opposite ends of the additional horizontally-extending structure 5*a*, and in distal ends of the two elongated members 2*a* and 2*b*.

Figure 2:
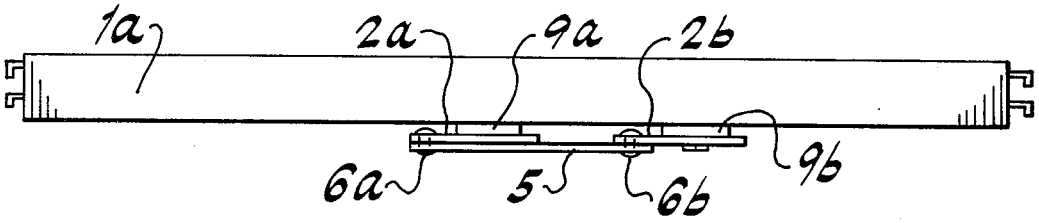
FIG. 2 illustrates a side view of a typical disengaged side member of a bed-frame, such as that illustrated in FIG. 1, with the same embodiment of the combination foot-rest mounted thereon, shown in a side view in somewhat diagrammatic representation.

The FIG. 2 illustration additionally shows the preferred gasket 9*a* and 9*b*, as well as better illustrating the support 10 which is best shown in FIG. 5 cross-sectional view. The support 10 prevents the foot-rest from loosely pressing downwardly when weight of a foot is thereon, by virtue of the portion 10*a* pressing against the upright portion 1*a*' of bed-frame side member 1*a*.

The FIG. 3 embodiment shows a one-piece T-shaped structure which pivots as above-described, having the elongated member 2*c* and the additional horizontally-extending structure continuous with and extending therefrom as structure 5*d*.

The FIG. 4 embodiment has the two elongated members, but with their proximal ends commonly mounted by bolt 3*d* and nut 7*d* pivotally, on a bed-frame side member.

Typical prior art patents include U.S. Pat. No. 2,975,436 showing a long stool-like step mounted between upper and lower bed legs adapted to swing under the bed, and likewise U.S. Pat. No. 2,941,215 shows a large fold-up foot stool mounted to swing under the bed by arms mounted on upright long supports spaced-apart and clamped onto a side frame member of a bed frame, and U.S. Pat. No. 3,629,881 which shows a mere hang-on step which always extends outwardly and is visible, in an alternate embodiment being foldable upwardly, i.e. flip-up and flip-down in nature.

I claim:

1. A bed frame foot-rest device comprising in combination: an elongated member and a pivot means at a proximate end thereof for mounting the elongated member for horizontal pivotal movement of the elongated member, for the mounting pivotally of the elongated member on a horizontal bed-frame support, such that a distal opposite end of the elongated member is supportable of a person's foot when a person is sitting on a side of a bed, as a foot-rest, and an additional horizontally-extending structure continuous with and extending from said distal opposite end at substantially a right angle to a longitudinal axis of said elongated member such that the additional horizontally-extending structure is substantially parallel to a side of a bed when said pivot means is mounted on a side member of a horizontal bed-frame support, and there being two of said elongated members, the distal end of the two elongated members being attached to opposite ends of said additional horizontally-extending structure, one attached to one end thereof and the other attached to the other opposite end thereof, and there being two of said pivot means, one proximate end of one of said two elongated members being mounted by one of the two pivot means and the other proximate end of said two elongated members being mounted by the other remaining one of the two pivot means, said additional horizontally-extending structure being pivotally mounted onto each of said distal ends, such that the additional horizontally-extending structure is collapsible in parallel alignment beneath a side member of a horizontal bed-frame support on which the two pivot means are mountable.

2. A bed frame foot-rest device of claim 1, in which said pivot means each include clamping structure detachably mountable onto a side member of a horizontal bed-frame support.

3. A bed frame foot-rest device of claim 2 including a side member of a horizontal bed-frame support, and said pivot means each including clamping structure detachably mountable onto said side member, and the side member having a bolt-mountable aperture through a horizontal portion of the side member, with said bolt being mounted through said bolt-mountable aperture and secured by said nut.

* * * * *